United States Patent [19]

Swartout

[11] Patent Number: 5,048,421

[45] Date of Patent: Sep. 17, 1991

[54] COMBUSTIBLE CARTRIDGE CASE BASE

[75] Inventor: Terry L. Swartout, Seminole, Fla.

[73] Assignee: Olin Corporation, Cheshire, Conn.

[21] Appl. No.: 562,774

[22] Filed: Aug. 6, 1990

[51] Int. Cl.[5] ..... F42B 5/18

[52] U.S. Cl. ..... 102/431; 102/467; 102/469

[58] Field of Search ..... 102/431, 432, 433, 467, 102/469, 470

[56] References Cited

U.S. PATENT DOCUMENTS

| | | | |
|---|---|---|---|
| 601,902 | 4/1898 | Oliver . | |
| 1,118,888 | 11/1914 | Butler . | |
| 2,083,665 | 6/1937 | Pihl et al. . | |
| 2,263,941 | 11/1941 | Albree . | |
| 2,294,822 | 9/1942 | Albree . | |
| 4,159,678 | 7/1979 | Luther et al. . | |
| 4,444,115 | 4/1984 | Romer et al. . | |
| 4,738,202 | 4/1988 | Hebert . | |
| 4,763,577 | 8/1988 | Romer et al. | 102/431 |
| 4,928,598 | 5/1990 | Sabranski et al. . | |

FOREIGN PATENT DOCUMENTS

| | | | |
|---|---|---|---|
| 17442 | 12/1916 | United Kingdom | 102/430 |

*Primary Examiner*—Richard W. Wendtland

*Attorney, Agent, or Firm*—John R. Wahl

[57] ABSTRACT

An ammunition cartridge comprises a combustible tubular case having a threaded open end having a uniform density of plastic resin at said end. A generally cup shaped head having a cylindrical peripheral wall provided with threads corresponding to said threaded open end is engaged with the threaded end so as to close the end. The resin is preferably a polyurethane resin and the threads are preferably 60 degree stub threads.

18 Claims, 1 Drawing Sheet

COMBUSTIBLE CARTRIDGE CASE BASE

BACKGROUND OF THE INVENTION

This invention relates generally to combustible cartridges and more particularly to an improved case construction utilizing threaded case components to form an improved metal head to case joint.

Combustible cases for large caliber ammunition have been used for a number of years. The advantage of using such cases is especially apparent in tank ammunition where disposal of spent cartridge cases is constrained by the cramped confines within the fighting vehicle. The combustible cases used in such ammunition are consumed during propellant ignition, leaving behind only the cartridge head containing the spent primer. Storage of spent cartridge heads measuring about three inches in length and five inches in diameter is much more convenient than wrestling with two foot hot long metal cases.

Typical combustible cartridge cases have a tubular body made of a cardboard type mixture such as wood fiber, kraft cellulose and nitrocellulose formed by the conventional beater additive or post impregnation processes. The outer surface of the body is impregnated with a plastic resin to protect the case from humidity and abrasion damage and add strength to the case.

The rear end of the tubular body generally has a cup shape with a central hole for passage of a primer flash tube through the end of the case into the propellant charge. A metal base or head is secured to this end of the combustible case by a snap ring and circular retainer arrangement with the primer stub or the base itself as is disclosed and shown in U.S. Pat. Nos. 4,159,678 and 4,928,598 to Luther et al.

Alternatively, the metal head to combustible case joint when the rear end of the case is a generally straight sided tube rather than a cupped end may be a snap fit arrangement utilizing a circumferential lip on or near the bottom end of the case to engage a corresponding bulge around the rim of the head such as is described in U.S. Pat. No. 4,738,202.

Another conventional method of securing the metal head to the case body is to provide the rear end of the case with a circumferential sleeve of a reduced diameter and gluing the sleeve to the inside of the rim of the metal head as is shown in U.S. Pat. No. 4,444,115 to Romer et al. The glue joint has the disadvantage that different coefficients of expansion between the metal and the cellulose combustible case may cause cracking and separation of the joint.

The snap fit arrangement has the disadvantage of being a relatively weak joint, susceptable of being popped apart when the cartridge is dropped. The snap ring and retainer arrangement has the disadvantage that the case must have a cupped shape rear end and therefore the case cannot be loaded from the rear with stick propellant. It must be loaded from the forward end. The glue joint has the disadvantage that it is permanent. It cannot be disassembled without damage to the case.

Accordingly there is a need for a secure metal base to case joint arrangement that permits rear loading of the propellant charge and retains the strength and rigidity of conventional connection, is removable and is simple to install and remove.

It is therefore an object of the present invention to provide an improved connection between combustible case and the metal head.

It is another object of the present invention to provide an improved threaded connection between the metal cartridge head and the combustible case.

SUMMARY OF THE INVENTION

The present invention basically comprises a combustible cartridge case having a threaded joint between the case body and the metal head attached to the rear of the case. The threaded portion of the case preferably has a uniform increased density of polyurethane or latex plastic resin throughout its wall thickness in the region of the threads to provide sufficient structural strength and machinability for the threads.

Although any thread type may be used in accordance with the invention, the threads are preferably of the helical modified 60 degree stub type having a preferred pitch of about 10 threads per inch. In addition, the threads preferably have a flat thread root for ease of machining and which optimally allows for expansion and contraction of the case at the connection without adverse holding effects due to temperature and humidity changes.

The rear end of the case is preferably of a reduced diameter than the main portion of the case and is threaded with external threads for joining with corresponding internal threads below the rim inside the metal head. The metal head preferably has a ring seal of elastomeric material above the threads to provide a moisture seal for the case and a pressure seal between the cartridge and the gun chamber in which the cartridge is loaded.

These and other objects, features and advantages of the invention will become more readily apparent from the following description when taken in conjunction with the accompanying drawing and appended claims.

DETAILED DESCRIPTION OF THE PREFERRED EMBODIMENTS

Figure 1:
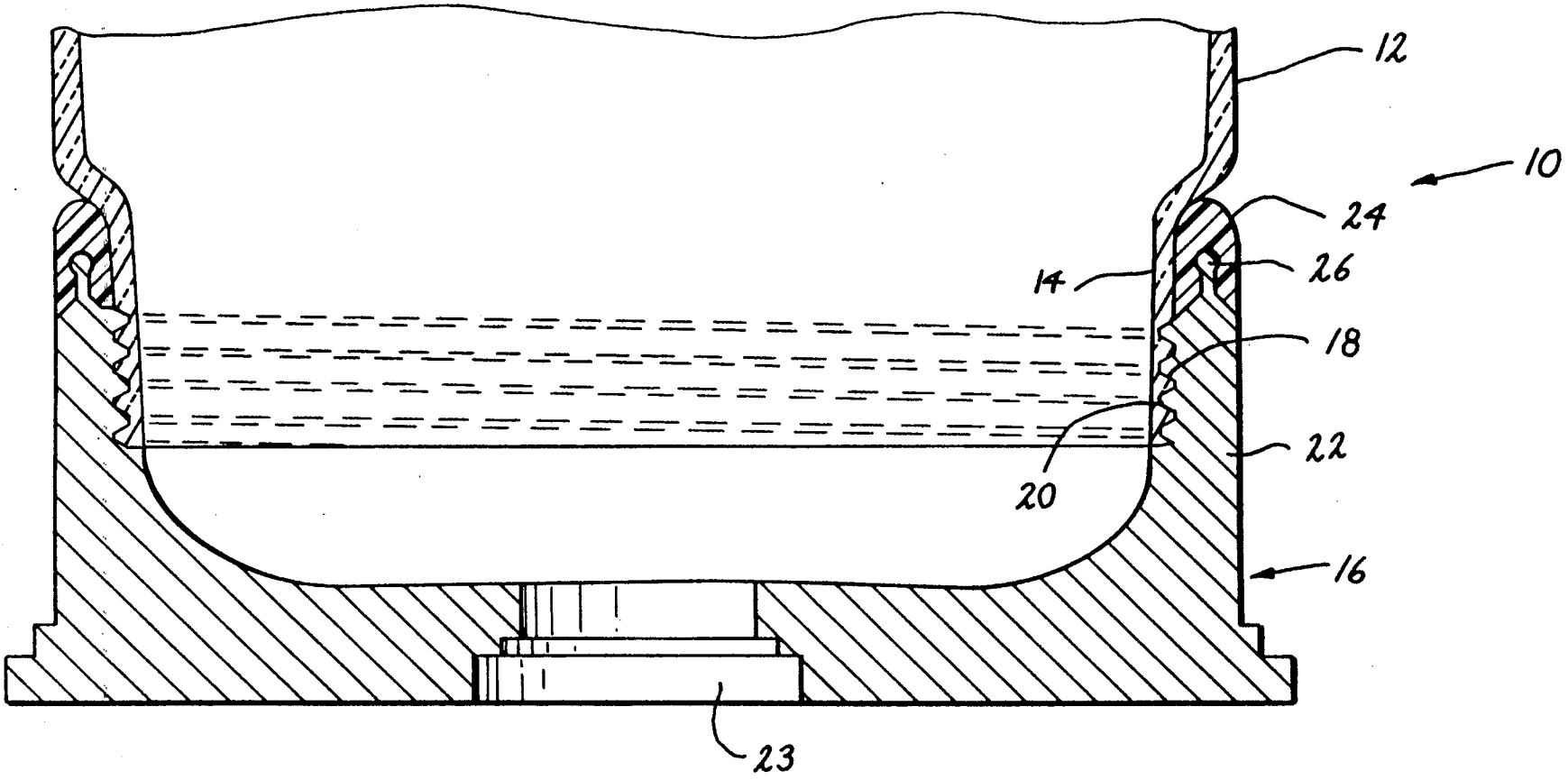
FIG. 1 is a partial sectional view of a cartridge case in accordance with the present invention.

The base portion of an ammunition cartridge 10 in accordance with the present invention is shown in FIG. 1. The cartridge 10 has a combustible tubular case 12 having a lower end 14 joined with a cup shaped metal head 16. The lower end 14 of the case 12 has a reduced diameter so as to fit within the head 16 and present a generally uniform outer case diameter. The lower end 14 has external threads 18 machined into its outer surface. These threads 18 engage complementary threads 20 machined in head 16 and are preferably 60 degree stub threads having a pitch of 0.10 but may be of other thread profiles.

The head 16 has a generally cupped shape with a flat flanged bottom end and a peripheral wall 22 normal to the bottom end. The threads 20 are machined into the inside surface of the peripheral wall 22. A bore 23 extends through the center of the head 16. This bore receives and supports a conventional primer assembly (not shown).

Extending axially from the wall 22 between the head and the case 12 is an annular seal ring 24 of a resilient polymeric material such as silicone rubber. This seal ring is interlocked, glued, or otherwise fastened onto an annular lip or tenon 26 protruding axially from the end of the wall 22. This seal ring provides a moisture seal between the case and the head and a pressure seal between the cartridge and the gun chamber into which the cartridge is loaded.

The lower end 14 is composed of conventional combustible case materials such as nitrocellulose, wood fiber, kraft cellulose, a stabilizer such as diphenylamine or methyl diphenylurea for the nitrocellulose, and a plastic resin. The case material is commonly known as a proxylene plastic material. However, the distribution of these materials within the case wall is different in the present invention. The case 12 in the present invention has an increased density of the plastic resin in the threaded end 14 and the end has a uniform density rather than having a density gradient as is conventionally present across the wall of the conventional combustible case.

The preferable plastic resin is a polyurethane resin. Alternatively a latex resin may be used. The felt density is decreased near the end of the case tube during formation so that a greater proportion of polyurethane resin is absorbed giving a resultant high uniform density at the end.

The uniform density at end 14 should be between about 0.45 and 1.00 to ensure that the combustible case performs satisfactorily. The density should be at least 0.45 or there will be insufficient strength to retain the threads. It should be less than about 1.00 or the material will not properly combust upon propellant ignition.

The resin density is preferably between about 0.55 and about 0.90 and has been found to be optimal at about 0.75 grams per cubic centimeter. The threads machined into the end 14 of the case tube 12 are preferably 60 degree stub threads having a pitch of about 0.10. Other thread profiles may also be used but it appears that the stub type having a flat root provides an optimum thread strength over a wide range of normal environmental conditions.

Although the invention has been shown and described with reference to one preferred embodiment, other variations and modifications are contemplated as being within the scope of the invention. Accordingly it is intended to embrace all such variations and modifications as defined by the scope of the appended claims. All patents, patent applications and other references referred to herein are hereby incorporated by reference in their entirety.

What is claimed is:

1. An ammunition cartridge comprising:

a combustible case having a tubular wall with a threaded open end, said case wall having a uniform density of plastic resin throughout said wall at said end; and a generally cup shaped head having a tubular peripheral wall provided with threads corresponding to said threaded open end engaged with said threaded end so as to close said end.

2. The cartridge according to claim 1 wherein said head has an annular rim and an annular seal of a polymeric material attached to and forming an axial extension of said peripheral wall.

3. The cartridge according to claim 1 wherein said threads on both said case end and said head are complementary stub threads.

4. The cartridge according to claim 2 wherein said plastic resin is a polyurethane resin.

5. The cartridge according to claim 4 wherein said case end has a uniform resin density of between 0.45 and 1.00 grams per cubic centimeter.

6. The cartridge according to claim 5 wherein said end has a uniform resin density of between about 0.55 and 0.90 grams per cubic centimeter.

7. The cartridge according to claim 6 wherein said end has a uniform density of about 0.75 grams per cubic centimeter.

8. The cartridge according to claim 2 wherein said plastic resin is a latex resin.

9. The cartridge according to claim 8 wherein said end has a uniform resin density of between 0.45 and 1.00 grams per cubic centimeter.

10. The cartridge according to claim 9 wherein said end has a uniform resin density of between about 0.55 and 0.90 grams per cubic centimeter.

11. The cartridge according to claim 10 wherein said end has a uniform density of about 0.75 grams per cubic centimeter.

12. The cartridge according to claim 1 wherein said one case end has a uniform resin density of between 0.45 and 1.00 grams per cubic centimeter.

13. The cartridge according to claim 12 wherein said one case end has a uniform resin density of between about 0.55 and 0.90 grams per cubic centimeter.

14. The cartridge according to claim 13 wherein said one case end has a uniform resin density of about 0.75 grams per cubic centimeter.

15. An ammunition cartridge comprising:

a combustible case having a tubular wall with a pair of opposite open ends, said case wall having a uniform density of polyurethane resin throughout said wall at one of said ends, said one end having 60 degree external stub threads thereon.

16. The cartridge according to claim 15 wherein said one case end has a uniform resin density of between 0.45 and 1.00 grams per cubic centimeter.

17. The cartridge according to claim 16 wherein said one case end has a uniform resin density of between about 0.55 and 0.90 grams per cubic centimeter.

18. The cartridge according to claim 17 wherein said one case end has a uniform resin density of about 0.75 grams per cubic centimeter.

* * * * *